United States Patent [19]

Koralik

[11] 4,206,924

[45] Jun. 10, 1980

[54] WEIGHTED GOLF CLUB HEAD

[76] Inventor: Larry Koralik, 453 Everett, Palatine, Ill. 60067

[21] Appl. No.: 883,818

[22] Filed: Mar. 6, 1978

[51] Int. Cl.[2] ..... A63B 53/04

[52] U.S. Cl. ..... 273/169

[58] Field of Search ..... 273/77 R, 167–174

[56] References Cited

U.S. PATENT DOCUMENTS

| | | | |
|---|---|---|---|
| 922,444 | 5/1909 | Youds | 273/169 |
| 1,306,029 | 6/1919 | Robertson | 273/171 |
| 1,666,174 | 4/1928 | Holland | 273/169 X |
| 2,332,342 | 10/1943 | Reach | 273/174 X |
| 3,652,094 | 3/1972 | Glover | 273/171 |
| 3,979,122 | 9/1976 | Belmont | 273/171 |
| 4,085,934 | 4/1978 | Churchward | 273/171 |

FOREIGN PATENT DOCUMENTS

| | | | |
|---|---|---|---|
| 252993 | 6/1926 | United Kingdom | 273/169 |
| 440379 | 12/1935 | United Kingdom | 273/171 |

*Primary Examiner*—Richard J. Apley

*Attorney, Agent, or Firm*—Dulin, Thienpont & Potthast Ltd.

[57] ABSTRACT

A weighted golf club head having disposed therein a plurality of small weights and positioned in a plurality of rows, said rows of weights being disposed substantially parallel to the club head face and at least one of said rows of weights spanning more than half the width of the club face in order to tend to equalize the energy transmitted to a golf ball during a swing of the golf club regardless of where along the club head face the ball comes in contact therewith.

2 Claims, 8 Drawing Figures

WEIGHTED GOLF CLUB HEAD

This invention relates to golf club heads and particularly to the weighting of golf club heads.

Most wooden or plastic golf club heads, i.e., the woods as distinguished from the irons, are weighted in some manner to give added energy upon striking a golf ball, the wood or plastic itself generally being too light. Presently known methods include center-weighting and heel-to-toe weighting.

In the center weighting method weights are concentrated at the middle of the club head face. In the heel-to-toe weighting method weights are placed along the club head face. The center weighting method has a disadvantage in that shots off-center either toward the toe or the heel of the club do not receive the benefit of the center positioned weight.

In the heel-to-toe weighting method the dispersion of the total added weight along the club face is effective to add energy to balls that are contacted by an off-center position of the club head but the reduced weight at the center of the club head, by comparison, does not provide as much energy as a club weighted by the center weighting method.

Accordingly it becomes appropriate to devise means whereby the club head of a golf wood may have the advantage of increased weighting dispersed along substantially the full width of the club face.

SUMMARY OF THE INVENTION

It is a principal object of the invention to provide an improved weighted golf club head.

Another object of this invention is to provide uniform and increased weighting in the head of golf club wood which will allow for the transmission of a substantially equal amount of energy to a golf ball regardless of where along the club face contact is made with the golf ball.

A further object of the invention is to position weights in the club head of a golf club wood in an arrangement whereby the weights in the golf club head are effective to transmit maximum energy to a golf ball regardless of where along the vertical dimension of the club face the ball is contacted during a golf swing.

Another object of the invention is to put as much lead weight as possible behind the entire club face hitting area without over-weighting the club.

Other objects and advantages of the invention will become more apparent from the following description and accompanying drawings.

DESCRIPTION OF PREFERRED EMBODIMENT

Figure 1:
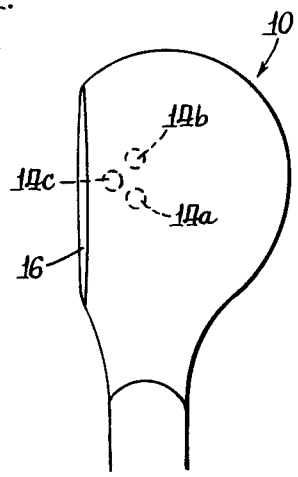
Fig. 1. PRIOR ART
FIG. 1 is a plan view of a golf club head showing a prior art structure with concentration of weights at the middle of the club face.
Figure 2:
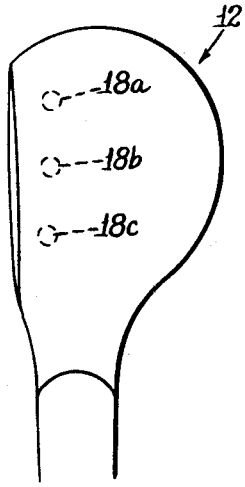
Fig. 2 PRIOR ART
FIG. 2 is a plan view of a golf club head showing another prior art structure having heel-to-toe weighting.

Turning now to drawings, FIGS. 1 and 2 are plan view of golf club heads 10 and 12 illustrating prior art structures. In FIG. 1 the center-weighting scheme of the prior art is illustrated. In such a construction the three weights 14*a*, 14*b* and 14*c* of the club head 10 are concentrated substantially midway along the face 16 of the club head 10. In FIG. 2 the heel-to-toe weighting scheme of the prior art is illustrated. In such a construction the three weights 18*a*, 18*b* and 18*c* are disposed in one row or line spaced slightly from a plane parallel to the club face 20.

In the center-weighting scheme of FIG. 1 the weights 14*a*, 14*b*, 14*c* are concentrated more at the middle of the club face while in the heel-to-toe scheme as shown in FIG. 2 the weights 18*a*, 18*b*, 18*c* spread along the club face.

Figure 3:
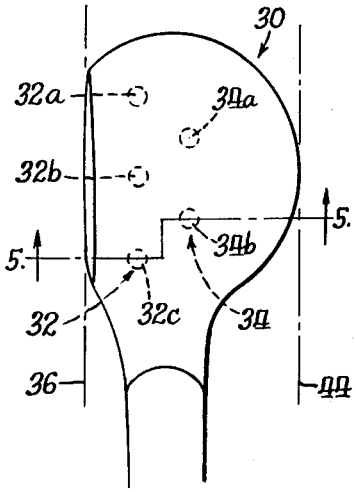
FIG. 3 is a plan view of a golf club "wood" head embodying the invention herein.

In my concept of weighting a golf club head I take advantage of the effects achieved by both the center-weighting and heel-to-toe weighting schemes. In the embodiment of FIG. 3 embodying the invention herein there is shown a golf club head 30 in which are incorporated two rows of weights 32 and 34 containing respectively weights 32*a*, 32*b*, and 32*c* and weights 34*a* and 34*b*. These weights preferably are in the form of round lead pins approximately ¼" in diameter. The longest row 32 preferably spans more than 50% of the width of the club face, the width referring to the dimension running from the heel to the toe of the club.

Figure 5:
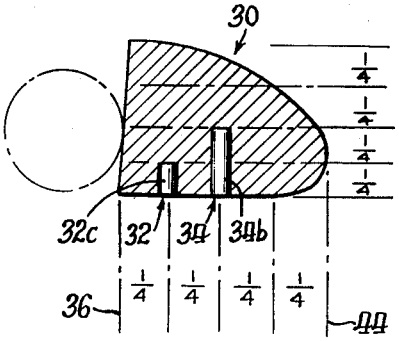
FIG. 5 is an elevation view in section taken along line 5—5 of FIG. 3.

As indicated in elevation view FIG. 5 the row of weights 32 are positioned approximately ¼ of the distance from a plane 36 through the lower edge of the club face to a parallel plane 44 tangent to the rearmost edge of the club head. These weights 32 are spaced far enough apart so that they extend along substantially more than half the width of the club face. The second row of 2 weights 34*a* and 34*b* is positioned approximately ½ of the distance from plane 36 to parallel plane 44. It will be observed that the row of weights 34 are laterally positioned at points substantially between weights 32*a*, 32*b* and 32*c* to present a staggered relationship between the weights of rows 32 and 34.

The effect of the added weights arranged in the manner that they are is to allow more energy to be transmitted to the golf ball. Furthermore the spacing of the weights is such that this increased value of energy to be transmitted is available all along the club face no matter where impact is made on the club head.

When individual weights of the type shown herein are used the longer row should contain at least three such weights and the shorter row should contain at least two such weights. A greater number of weights could be used, and this may be dictated to some extent by the size of the club head and the size of the weights used. It is conceivable, of course, that different configurations of weights might be used than here illustrated to distribute weight across substantially the full width of the club face. For example, small ball weights might be used, with one or more balls being inserted into each elongated bore.

Figure 4:
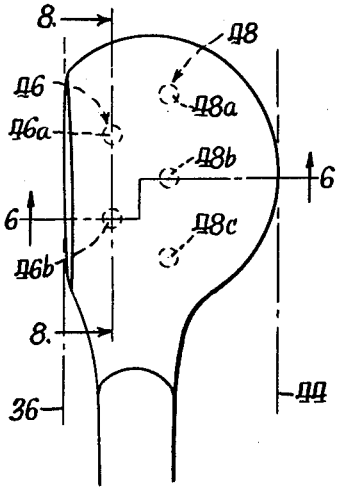
FIG. 4 is a plan view of another golf club head embodying the invention herein but showing a different arrangement of weights.
Figure 8:
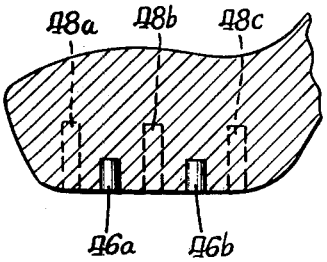
FIG. 8 is an elevation view in section taken along line 7—7 of FIG. 4.
Figure 6:
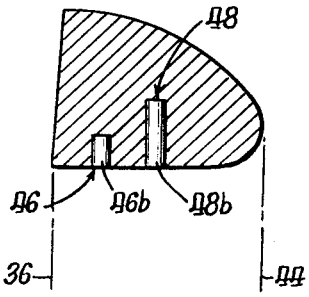
FIG. 6 is an elevation view in section taken along line 6—6 of FIG. 4.
Figure 7:
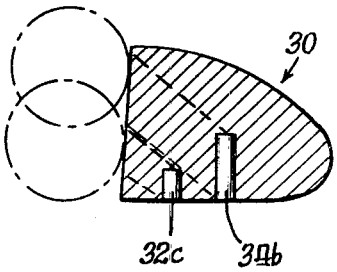
FIG. 7 is an elevation view in section taken along line 5—5 of FIG. 3 illustrating the effect of the weights on golf balls making contact with the club face at different points on the latter.

The embodiment illustrated in FIGS. 4 and 6 is slight modification to the extent that the front row of weights 46, that is, those weights closest to the club face, includes only two weights 46*a* and 46*b* and the rear row of weights 48 includes three weights 48*a*, 48*b* and 48*c*, just the reverse of the arrangement shown in FIGS. 3 and 5. The effect, however, is the same—namely, greater distribution of weight across the width of the club face.

As here illustrated the lengths of the weights in the two rows vary. For example as seen in FIGS. 5 and 6 one row of weights extends substantially one-half way upwardly into the club head from the base while the other row of weights extends substantially one quarter of the way into the club head. This allows for maximum effect of the weight on the ball trajectory regardless of where along the height of the club head face contact is made with the ball. Under certain conditions the weights may all be of the same size. They all may be of the size of the weights in row 32, for example.

Whether the weights of one row are longer than the weights of another row may depend on the size and configuration of the club head in the first instance. With a club head having a shallow profile, i.e., the club head being relatively shallow in thickness, the added length weights may not be necessary.

The weights referred to herein may be inserted in openings in the club head and then secured therein by means of an epoxy glue. If small ball weights are used these also may be secured in place by an epoxy glue.

It will be appreciated that more than two rows of weights could be used. Keeping in mind that the basic objective is to distribute the weights in the club head over a major portion of the width of the club head to equalize the energy transmission of the full club face. Generally speaking, however, two rows of weights appear to be sufficient to accomplish the desired objective. Furthermore, more than three weights in one row and two weights in the other row could be used.

If the club head turns out to be slightly too heavy with weights added as illustrated this may be compensated for by removing material from the club head such as by drilling small holes in the rear portion of the club head, i.e., in the portion most distant from the club face. Such holes may be filled with partial wooden plugs which are sealed in place.

Because of the increased weight of the club head a very light club shaft should be used with the improved weighted head of the invention to give the club proper balance.

While the invention has been described herein particularly with reference to golf club woods it will be appreciated that the same principles of weighting and distribution of weights could be applied to golf club irons if club head of the latter is appropriately designed to accommodate the added weights.

What is claimed is:

1. In an integral golf club head having a club face, the improvement comprising:

a plurality of small individual weights inside the club head arranged in first and second rows substantially parallel to and adjacent the club face and to each other;

said first row of weights including more than two weights which are equally spaced and are distributed along a line substantially parallel to the club face;

said second row of weights comprising a plurality of weights arranged in a staggered relationship with respect to the weights in said first row;

one of the first and second rows of weights being disposed at a greater distance from the club head face than the other, the weights of said one row extending further into the club head measured from the sole of the club than the row of weights disposed most closely adjacent the club face.

2. In an integral golf club head having a club face, the improvement comprising:

a plurality of small individual weights inside the club head arranged in first and second rows substantially parallel to and adjacent the club face and to each other;

said first row of weights including more than two weights which are equally spaced and are distributed along a line substantially parallel to the club face;

said second row of weights comprising a plurality of weights arranged in a staggered relationship with respect to the weights in said first row;

said weights comprising round lead pins of approximately ¼" in diameter; and the row of weights disposed the furthest distance from the club face being longer than the weights disposed most closely to the club face.

* * * * *